US006521115B2

(12) United States Patent
Duruz et al.

(10) Patent No.: US 6,521,115 B2
(45) **Date of Patent: *Feb. 18, 2003**

(54) NICKEL-IRON ALLOY-BASED ANODES FOR ALUMINIUM ELECTROWINNING CELLS

(75) Inventors: Jean-Jacques Duruz, Geneva (CH); Vittorio de Nora, Nassau (BM); Olivier Crottaz, Petit-Lancy (CH)

(73) Assignee: Moltech Invent S. A. (LU)

( * ) Notice: Subject to any disclaimer, the term of this patent is extended or adjusted under 35 U.S.C. 154(b) by 94 days.

This patent is subject to a terminal disclaimer.

(21) Appl. No.: 09/772,285

(22) Filed: Jan. 29, 2001

(65) Prior Publication Data

US 2001/0019017 A1 Sep. 6, 2001

Related U.S. Application Data

(63) Continuation of application No. PCT/IB99/01361, filed on Jul. 30, 1999.

(51) Int. Cl.[7] ..... C25C 3/08

(52) U.S. Cl. ..... 205/387; 205/372; 205/384; 205/385; 204/247.3; 204/243.1; 204/291; 204/293

(58) Field of Search ..... 204/247.3, 243.1, 204/280, 291, 292, 293; 205/372, 384, 385, 387

(56) References Cited

U.S. PATENT DOCUMENTS 6,248,227 B1 * 6/2001 De Nora et al. ..... 204/243.1
6,372,099 B1 * 4/2002 Duruz et al. ..... 204/245

* cited by examiner

*Primary Examiner*—Bruce F. Bell
(74) *Attorney, Agent, or Firm*—Jayadeep R. Deshmukh

(57) ABSTRACT

An anode of a cell for the electrowinning of aluminium comprises an iron-nickel alloy body or layer whose surface is oxidised to form a coherent and adherent outer iron oxide-based layer, in particular hematite, the surface of which is electrochemically active for the oxidation of oxygen ions and which reduces diffusion of oxygen from the electrochemically active surface into the iron-nickel alloy body or layer. The anode may be kept dimensionally stable during cell operation by maintaining a sufficient amount of dissolved alumina and iron species in the electrolyte to prevent dissolution of the outer oxide layer of the or each anode and by reducing the electrolyte operating temperature to limit dissolution of iron and by reducing the electrolyte operating temperature to limit dissolution of iron species in the electrolyte.

53 Claims, No Drawings

NICKEL-IRON ALLOY-BASED ANODES FOR ALUMINIUM ELECTROWINNING CELLS

This application is a continuation of the US designation of PCT/IB99/01361 filed on Jul. 30, 1999.

FIELD OF THE INVENTION

This invention relates to non-carbon, metal-based, anodes for use in cells for the electrowinning of aluminium by the electrolysis of alumina dissolved in a fluoride-containing molten electrolyte such as cryolite, and to methods for their fabrication, as well as to electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Héroult, has not evolved as many other electrochemical processes.

The anodes are still made of carbonaceous material and must be replaced every few weeks. During electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

Using metal anodes in aluminium electrowinning cells would drastically improve the aluminium process by reducing pollution and the cost of aluminium production.

U.S. Pat. No. 4,614,569 (Duruz/Derivaz/Debely/Adorian) describes anodes for aluminium electrowinning coated with a protective coating of cerium oxyfluoride, formed in-situ in the cell or pre-applied, this coating being maintained by the addition of cerium to the molten cryolite electrolyte. This made it possible to have a protection of the surface only from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective oxygen barrier layer. However, full protection of the alloy substrate was difficult to achieve.

Metal or metal-based anodes are highly desirable in aluminium electrowinning cells instead of carbon-based anodes. As mentioned hereabove, many attempts were made to use metallic anodes for aluminium production, however they were never adopted by the aluminium industry.

OBJECTS OF THE INVENTION

A major object of the invention is to provide an anode for aluminium electrowinning which has no carbon so as to eliminate carbon-generated pollution and increase the anode life.

A further object of the invention is to provide an aluminium electrowinning anode material with a surface having a high electrochemical activity for the oxidation of oxygen ions for the formation of bimolecular gaseous oxygen and a low solubility in the electrolyte.

Another object of the invention is to provide an anode for the electrowinning of aluminium which is covered with an electrochemically active layer with limited ionic conductivity for oxygen ions.

Yet another object of the invention is to provide an anode for the electrowinning of aluminium which is made of readily available material(s).

An important object of the invention is to substantially reduce the solubility of the surface layer of an aluminium electrowinning anode, thereby maintaining the anode dimensionally stable.

Yet another object of the invention is to provide operating conditions for an aluminium electrowinning cell under which the contamination of the product aluminium is limited.

SUMMARY OF THE INVENTION

The invention is based on the fact that iron-nickel alloys when oxidised form a dense and coherent oxide layer consisting essentially of iron oxide, in particular hematite. As this oxide layer is well adherent to the non-oxidised iron-nickel alloy and also electrochemically active for the oxidation of oxygen ions, it can be used as an electrochemically active surface for the oxidation of oxygen ions of an anode for the electrowinning of aluminium. Small scale tests have also shown that such an iron oxide-based layer has a slow dissolution rate in fluoride-containing molten electrolyte which can even be substantially suppressed under favourable cell operating conditions.

Therefore, the invention relates to an anode of a cell for the electrowinning of aluminium by the electrolysis of alumina dissolved in a fluoride-containing molten electrolyte. The anode comprises an iron-nickel alloy body or layer whose surface is oxidised to form a coherent and adherent outer iron oxide-based layer, in particular a hematite-based layer, the surface of which is electrochemically active for the oxidation of oxygen ions and which reduces diffusion of oxygen from the electrochemically active surface into the iron-nickel alloy body or layer.

The surface oxidation of the iron-nickel alloy body may be such as to form an iron oxide-based layer comprising a dense iron oxide outer portion, a microporous iron oxide portion which separates the outer portion from a two-phase inner portion, one phase containing iron oxide, the other phase containing a nickel metal.

The surface of the iron-nickel alloy body or layer may be oxidised in a molten electrolyte at 800 to 1000° C. for 5 to 15 hours. Alternatively, the surface of the iron-nickel alloy body or layer may be oxidised at 750 to 1150° C. for 5 to 100 hours, in particular 20 to 75 hours at average temperature or below 25 hours at elevated temperature, in an oxidising atmosphere such as air or oxygen.

Usually, the iron-nickel alloy body or layer comprises 50 to 95 weight % iron and 5 to 50 weight % nickel, preferably 50 to 80 weight % iron and 20 to 50 weight % nickel, and even more preferably 60 to 70 weight % iron and 30 to 40 weight % nickel, i.e. with optionally up to 45 weight % of further constituents providing it is still capable of forming an iron oxide-based electrochemically active layer. Normally, the iron-nickel alloy comprises less than 30 weight %, in particular less than 20 weight % and often less than 10 weight %, of further constituents. Such constituents may be added to improve the mechanical and/or electrical properties of the anode substrate, and/or the adherence, the electrical conductivity and/or the electrochemical activity of the anode layer.

Alternatively, the iron-nickel alloy body or layer may comprise more than 50 weight % nickel, as described below.

The iron-nickel alloy body or layer may in particular comprise in addition to iron and nickel the following constituents in the given proportions: up to 15 weight % of chromium and/or additional alloying metals selected from titanium, copper, molybdenum, aluminium, hafnium, manganese, niobium, silicon, tantalum, tungsten, vanadium, yttrium and zirconium, in a total amount of up to 5 weight %. Furthermore, nickel present in the iron-nickel alloy may be partly substituted with cobalt. The iron-nickel alloy may contain up to 30 weight % of cobalt.

The anode may comprise a layer of iron-nickel alloy on an oxidation resistant and preferably highly electrically conductive metallic core, such as copper or a copper alloy, possibly containing minor amounts of at least one oxide reinforcing the mechanical properties of the metallic core. The reinforcing oxides may be selected from alumina, hafnia, yttria and zirconia.

This metallic core may be coated with at least one metal selected from nickel, chromium, cobalt, iron, aluminium, hafnium, manganese, molybdenum, niobium, silicon, tantalum, titanium, tungsten, vanadium, yttrium and zirconium, and alloys, intermetallic compounds and combinations thereof.

The metallic core may be coated with an intermediate protective layer against oxidation.

A layer of iron-nickel alloy may be applied on an oxidation resistant metallic core before or after formation of said outer iron oxide-based layer. The iron-nickel alloy layer may be plasma sprayed, arc sprayed, chemically or electrochemically deposited on the metallic core.

Optionally, the iron-nickel alloy layer may be bonded to the metallic core through at least one intermediate layer, such as a film of silver and/or at least one layer of nickel and/or copper.

The invention also relates to a bipolar electrode of a cell for the electrowinning of aluminium by the electrolysis of alumina dissolved in a fluoride-containing electrolyte, comprising on its anodic side an anode as described above.

Another aspect of the invention is a method of manufacturing an anode as described above. The method comprises: providing an iron-nickel alloy body or layer; and oxidising the surface of the iron-nickel alloy body or layer to form a coherent and adherent outer iron oxide-based layer the surface of which is electrochemically active for the oxidation of oxygen ions.

When a nickel-rich iron-nickel- alloy body or layer, i.e. having a nickel content above 50 weight %, in particular between 60 and 80 weight %, is pre-oxidised to manufacture an anode, a composite oxide layer may form on the alloy body or layer. Such a composite oxide layer usually comprises an iron oxide-rich electrochemically active outer layer separated by a nickel ferrite-rich intermediate layer from the iron-nickel alloy body or layer. The nickel-ferrite intermediate layer acts as a selective membrane in the sense that it inhibits subsequent oxygen diffusion to the alloy body or layer but permits migration of iron metal from the alloy body or layer towards the electrochemically active outer layer thereby inhibiting direct oxidation of the alloy body or layer during use.

Therefore, the invention relates also to an anode of an aluminium electrowinning cell which comprises a nickel-iron alloy-containing body or layer, an electrochemically-active iron oxide-based outside layer, in particular a hematite layer, and a nickel-ferrite selective membrane between the iron oxide-containing outside layer and the nickel-iron alloy-containing body or layer. The nickel-ferrite selective membrane prevents oxidation of the nickel-iron alloy-containing body or layer but permits migration of iron metal from the nickel-iron alloy-containing body or layer to the iron oxide-containing outside layer where the migrated iron metal is oxidised to form iron oxide. The nickel-ferrite selective membrane is formed by surface oxidation of the nickel-iron alloy-containing body or layer.

The nickel-iron alloy-containing body or layer may comprise a nickel-iron weight ratio greater than 1, in particular from 1.5 to 4.

Cells and Aluminium Production

A further aspect of the invention is a cell for the electrowinning of aluminium by the electrolysis of alumina dissolved in a fluoride-containing electrolyte comprising at least one anode as described above.

During normal operation the electrochemically active layer of the or each anode may be progressively further formed by surface oxidation of the iron-nickel alloy body or layer by controlled oxygen diffusion through the electrochemically active layer, and progressively dissolved into the electrolyte at the electrolyte/anode interface, the rate of formation of the outer iron oxide-based layer being substantially equal to its rate of dissolution into the electrolyte.

Alternatively, it has been observed that this type of anode may be maintained dimensionally stable under specific cell operating conditions.

In known processes, even the least soluble anode material releases excessive amounts of constituents into the bath, which leads to an excessive contamination of the product aluminium. For example, the concentration of nickel (a frequent component of proposed metal-based anodes) found in aluminium produced in small scale tests at conventional cell operating temperatures is typically comprised between 800 and 2000 ppm, i.e. 4 to 10 times the maximum acceptable level which is 200 ppm.

Iron oxides and in particular hematite ($Fe_2O_3$) have a higher solubility than nickel in molten electrolyte. However, in industrial production the contamination tolerance of the product aluminium by iron is also much higher (up to 2000 ppm) than for other metal impurities.

Solubility is an intrinsic property of anode materials and cannot be changed otherwise than by modifying the electrolyte composition and/or the operating temperature of a cell.

Small scale tests utilising a $NiFe_2O_4$/Cu cermet anode and operating under steady conditions were carried out to establish the concentration of iron in molten electrolyte and in the product aluminium under different operating conditions.

In the case of iron oxide, it has been found that lowering the temperature of the electrolyte decreases considerably the solubility of iron species. This effect can surprisingly be exploited to produce a major impact on cell operation by limiting the contamination of the product aluminium by iron.

Thus, it has been found that when the operating temperature of the cell is reduced below the temperature of conventional cells (950–970° C.) an anode covered with an outer layer of iron oxide can be made dimensionally stable by maintaining a concentration of iron species and alumina in the molten electrolyte sufficient to reduce or suppress the dissolution of the iron-oxide layer, the concentration of iron species being low enough not to exceed the commercial acceptable level of iron in the product aluminium.

The presence of dissolved alumina in the electrolyte at the anode surface has a limiting effect on the dissolution of iron from the anode into the electrolyte, which reduces the concentration of iron species necessary to substantially stop dissolution of iron from the anode.

Therefore, anodes according to the invention may be kept dimensionally stable by maintaining a sufficient amount of dissolved alumina and iron species in the electrolyte to reduce or prevent dissolution of the outer oxide layer.

The cell should be operated at a sufficiently low temperature to limit the solubility of iron species in the electrolyte, thereby limiting the contamination of the product aluminium by constituents of the outer iron oxide-based layer of the anode(s) to a commercially acceptable level.

When the cell is operated with a fluoride-based melt the operating temperature of the electrolyte should be above 700° C., usually from 820 to 870° C.

The amount of iron species and alumina dissolved in the electrolyte preventing dissolution of the iron oxide-based outside surface layer of the or each anode should be such that the product aluminium is contaminated by no more than 2000 ppm iron, preferably by no more than 1000 ppm iron, and even more preferably by no more than 500 ppm iron.

Usually the iron species are intermittently fed into the electrolyte, for instance together with alumina, to maintain the amount of iron species in the electrolyte constant which, at the operating temperature, prevents the dissolution of the iron oxide-based outside surface layer of the anodes.

However, the iron species can also be a continuously fed, for instance by dissolving a sacrificial electrode which continuously feeds the iron species into the electrolyte.

An electrical voltage may be applied to the sacrificial electrode. The applied voltage should be lower than the voltage of oxidation of oxygen O—. An electrical current may be supplied to the sacrificial electrode to control and/or promote the dissolution of the sacrificial electrode into the electrolyte. The electrical current may be adjusted so that it corresponds to a current necessary for the dissolution of the required amount of iron species into the electrolyte replacing the iron which is cathodically reduced and not otherwise compensated.

The iron species may be fed in the form of iron metal and/or an iron compound, in particular iron oxide, iron fluoride, iron oxyfluoride and/or an iron-aluminium alloy.

Advantageously, the cell may comprise an aluminium-wettable cathode which can be a drained cathode on which aluminium is produced and from which it continuously drains, as described in U.S. Pat. No. 5,651,874 (de Nora/Sekhar) and U.S. Pat. No. 5,683,559 (de Nora).

Usually, the cell is in a monopolar, multi-monopolar or bipolar configuration. The bipolar cell comprises a terminal cathode facing a terminal anode and thereinbetween at least one bipolar electrode, the anode(s) described above forming the anodic side of the or each bipolar electrode and/or of the terminal anode.

In such a bipolar cell an electric current is passed from the surface of the terminal cathode to the surface of the terminal anode as ionic current in the electrolyte and as electronic current through the bipolar electrodes, thereby electrolysing the alumina dissolved in the electrolyte to produce aluminium on each cathode surface and oxygen on each anode surface.

Preferably, the cell comprises means to improve the circulation of the electrolyte between the anodes and facing cathodes and/or means to facilitate dissolution of alumina in the electrolyte. Such means can for instance be provided by the geometry of the cell as described in copending application PCT/IB99/00222 (de Nora/Duruz) or by periodically moving-the anodes as described in co-pending application PCT/IB99/00223 (Duruz/Bellò).

Yet another aspect of the invention is a method of producing aluminium in a cell for the electrowinning of aluminium by the electrolysis of alumina dissolved in a molten fluoride-containing electrolyte having at least one anode as described above facing at least one cathode. The method comprises dissolving alumina in the electrolyte and passing an ionic electric current between the electrochemically active surface of the anode(s) and the surface of the cathode(s), thereby electrolysing the dissolved alumina to produce aluminium on the cathode surface(s) and oxygen on the anode surface(s).

Yet a further aspect of the invention is a method of manufacturing an anode and producing aluminium in an electrolytic cell comprising inserting an anode precursor as described above into the electrolyte of an electrolytic cell and forming the iron oxide-based layer to produce a fully manufactured anode and electrolysing alumina in the same (or nearly the same) electrolyte or in a different electrolyte to produce oxygen on the surface of the electrochemically active iron oxide-based layer and aluminium on a facing cathode.

The thus-produced anode may then be transferred from the electrolytic cell in which it was produced to an aluminium electrowinning cell. Alternatively the composition of the electrolyte in which the anode was produced can be suitably modified, for instance by dissolving alumina and optionally iron species, and electrolysis continued in the same cell to produce aluminium.

DETAILED DESCRIPTION

The invention will be further described in the following Examples:

EXAMPLE 1

Aluminium was produced in a laboratory scale cell equipped with an anode according to the invention.

The anode was made by pre-oxidising in air at about 850° C. for 24 hours a substrate of an iron-nickel alloy consisting of 70 weight % iron and 30 weight % nickel, thereby forming a dense hematite-based surface layer on the alloy.

The anode was then tested in a fluoride-containing molten electrolyte at 850° C. containing NaF and $AlF_3$ in a weight ratio $NaF/AlF_3$ of 0.8 and approximately 4 weight % alumina at a current density of about 0.8 $A/cm^2$. Furthermore, the electrolyte contained approximately 180 ppm iron species obtained from the dissolution of iron oxide thereby saturating the electrolyte with iron species and inhibiting dissolution of the hematite-based anode surface layer.

To maintain the concentration of dissolved alumina in the electrolyte, fresh alumina was periodically fed into the cell. The alumina feed contained sufficient iron oxide so as to replace the iron which had deposited into the product aluminium, thereby maintaining the concentration of iron in the electrolyte at the limit of solubility and preventing dissolution of the hematite-based anode surface layer.

The anode was extracted from the electrolyte after 100 hours and showed no sign of significant internal or external corrosion after microscopic examination of a cross-section of the anode specimen.

The produced aluminium was also analysed and showed an iron contamination of about 800 ppm which is below the tolerated iron contamination in commercial aluminium production.

EXAMPLE 2

As in Example 1, aluminium was produced in a laboratory scale cell equipped with an anode according to the invention.

The anode was made by pre-oxidising in air at about 950° C. for 24 hours a substrate of an iron-nickel alloy consisting of 65 weight % iron, 25 weight % nickel, 7 weight % cobalt and 3 weight % of doping elements, thereby forming a dense hematite-based surface layer on the alloy.

The anode was then tested in a fluoride-containing molten electrolyte at 850° C. containing NaF and $AlF_3$ in a weight ratio $NaF/AlF_3$ of 0.8 and approximately 4 weight % alumina at a current density of about 0.7 $A/cm^2$. Furthermore, the electrolyte contained approximately 200 ppm iron species obtained from the dissolution of iron oxide thereby surely saturating the electrolyte with iron species and inhibiting dissolution of the hematite-based anode surface layer.

To maintain the concentration of dissolved alumina in the electrolyte, fresh alumina was periodically fed into the cell. The alumina feed contained sufficient iron oxide so as to replace the iron which had been deposited into the product aluminium, thereby maintaining the concentration of iron in the electrolyte at the limit of solubility and preventing dissolution of the hematite-based anode surface layer.

The anode was operated for 140 hours and extracted, and after cooling the anode was examined externally and in cross-section. No corrosion was observed at or near the surface of the anode.

The produced aluminium was also analysed and showed an iron contamination of about 750 ppm which is below the tolerated iron contamination in commercial aluminium production.

This example can be repeated by oxidising an iron-nickel anode consisting of 40 weight % iron and 60 weight % nickel in air at 1150° C. for 72 hours in a furnace to form an electrochemically active oxide layer on the substrate and using the anode under similar conditions.

What is claimed is:

1. An anode of a cell for the electrowinning of aluminium by the electrolysis of alumina dissolved in a fluoride-containing molten electrolyte, said anode comprising an iron-nickel alloy body or layer whose surface is oxidised to form a coherent and adherent outer iron oxide-based layer, the surface of which is electrochemically active for the oxidation of oxygen ions and which reduces diffusion of oxygen from the electrochemically active surface into the iron-nickel alloy body or layer.

2. The anode of claim 1, wherein-the iron-nickel alloy body or layer comprises 5 to 85 weight % nickel.

3. The anode of claim 2, wherein the iron-nickel alloy body or layer comprises 50 to 95 weight % iron and 5 to 50 weight % nickel.

4. The anode of claim 3, wherein the iron-nickel alloy body or layer comprises 50 to 80 weight % iron and 20 to 50 weight % nickel.

5. The anode of claim 4, wherein the iron-nickel alloy body or layer comprises 60 to 70 weight % iron and 30 to 40 weight % nickel.

6. The anode of claim 2, wherein the nickel of the iron-nickel alloy body or layer is partly substituted with cobalt.

7. The anode of claim 8, wherein the anode comprises up to 30 weight % cobalt.

8. The anode of claim 1, wherein the iron-nickel alloy body or layer comprises up to 15 weight % chromium.

9. The anode of claim 1, wherein the iron-nickel alloy body or layer comprises one or more additional alloying metals selected from titanium, copper, molybdenum, aluminium, hafnium, manganese, niobium, silicon, tantalum, tungsten, vanadium, yttrium and zirconium, in a total amount of up to 5 weight %.

10. The anode of claim 1, comprising a layer of iron-nickel alloy on an oxidation resistant metallic core.

11. The anode of claim 10, wherein the metallic core is made of copper or a copper alloy, optionally containing at least one oxide reinforcing the mechanical properties of the metallic core.

12. The anode of claim 11, wherein said at least one reinforcing oxide is selected from alumina, hafnia, yttria and zirconia.

13. The anode of claim 11, wherein the metallic core is coated with at least one metal selected from nickel, chromium, cobalt, iron, aluminium, hafnium, manganese, molybdenum, niobium, silicon, tantalum, titanium, tungsten, vanadium, yttrium and zirconium, and alloys, intermetallic compounds and combinations thereof.

14. The anode of claim 11, wherein the metallic core is coated with an intermediate protective layer against oxidation.

15. The anode of claim 10, wherein the iron-nickel alloy layer is bonded to the metallic core through at least one intermediate layer.

16. The anode of claim 15, wherein the iron-nickel alloy layer is bonded to the metallic core through a film of silver, and/or at least one layer of nickel and/or copper.

17. A bipolar electrode of a cell for the electrowinning of aluminium by the electrolysis of alumina dissolved in a fluoride-containing electrolyte, comprising on its anodic side an anode as defined in claim 1.

18. A method of manufacturing an anode as defined in claim 1 comprising:

providing an iron-nickel alloy body or layer; and oxidising the surface of the iron-nickel alloy body or layer to form a coherent and adherent outer iron oxide-based layer the surface of which is electrochemically active for the oxidation of oxygen ions.

19. The method of claim 18, wherein the surface of the iron-nickel alloy body is oxidised to form an iron oxide-based layer comprising a dense iron oxide outer portion, a microporous iron oxide portion which separates the outer portion from a two-phase inner portion, one phase containing iron oxide, the other phase containing a nickel metal.

20. The method of claim 18, comprising applying a layer iron-nickel alloy on an oxidation resistant metallic core before or after formation of said outer iron oxide-based layer.

21. The method of claim 20, comprising plasma spraying, arc spraying, chemically or electrochemically depositing the iron-nickel alloy layer on the metallic core.

22. The method of claim 20, comprising bonding the iron-nickel alloy layer to the metallic core through at least one intermediate bonding layer.

23. The method of claim 18, comprising oxidising the surface of the iron-nickel alloy body or layer in a molten electrolyte at 800 to 1000° C. for 5 to 15 hours.

24. The method of claim 23, comprising oxidising the surface of the iron-nickel alloy body or layer at 750 to 1150° C. for 5 to 100 hours in an oxidising atmosphere, selected from the group consisting of air or oxygen.

25. A method of producing aluminium in a cell for the electrowinning of aluminium by the electrolysis of alumina dissolved in a fluoride-containing molten electrolyte having at least one anode as defined in claim 1 facing at least one cathode, the method comprising dissolving alumina in the electrolyte and passing an ionic electric current between the electrochemically active surface of the anode(s) and the surface of the cathode(s), thereby electrolysing the dissolved alumina to produce aluminium on the cathode surface(s) and oxygen on the anode surface(s).

26. The method of claim 25, wherein the electrochemically active layer of the or each anode is progressively further formed by surface oxidation of the iron-nickel alloy body or layer by controlled oxygen diffusion through the electrochemically layer, and progressively dissolved into the electrolyte at the electrolyte/anode interface, the rate of formation of the outer iron oxide-based layer being substantially equal to its rate of dissolution into the electrolyte.

27. The method of claim 25, comprising keeping the or each anode dimensionally stable by maintaining a sufficient amount of dissolved alumina and iron species in the electrolyte to prevent dissolution of the outer oxide layer of the or each anode.

28. The method of claim 27, wherein iron species are intermittently or continuously fed into the electrolyte to maintain the amount of iron species in the electrolyte which prevents at the operating temperature the dissolution of the iron oxide-based outside surface layer of the or each anode.

29. The method of claim 28, wherein the iron species are fed in the form of iron metal and/or an iron compound.

30. The method of claim 29, wherein the iron species are fed into the electrolyte in the form of iron oxide, iron fluoride, iron oxyfluoride and/or an iron-aluminium alloy.

31. The method of claim 28, wherein the iron species are periodically fed into the electrolyte together with alumina.

32. The method of claim 28, wherein a sacrificial electrode continuously feeds the iron species into the electrolyte.

33. The method of claim 32, comprising applying an electrical voltage which is lower than the voltage of oxidation of oxygen and supplying an electrical current to the sacrificial electrode to control and/or promote the dissolution of the sacrificial electrode into the electrolyte.

34. The method of claim 33, comprising adjusting the electrical current supplied to the sacrificial electrode so that it corresponds to a current necessary for the dissolution of the required amount of iron species into the electrolyte replacing the iron which is cathodically reduced and not otherwise compensated.

35. The method of claim 25, comprising operating the cell at a sufficiently low temperature to limit the solubility of the outer iron oxide-based layer of the anode(s), thereby limiting the contamination of the product aluminium by constituents of the outer iron oxide-based layer of the anode(s).

36. The method of claim 35, wherein the cell is operated with an operating temperature of the electrolyte above 700° C.

37. The method of claim 36, wherein the cell is operated at an electrolyte temperature from 820 to 870° C.

38. The method of claim 35, wherein the amount of iron species and alumina dissolved in the electrolyte preventing dissolution of the iron oxide-based outside surface layer of the or each anode is such that the product aluminium is contaminated by no more than 2000 ppm iron, preferably by no more than 1000 ppm iron, and even more preferably by no more than 500 ppm iron.

39. The method of claim 25, for producing aluminium on an aluminium-wettable cathode.

40. The method of claim 39, wherein the produced aluminium continuously drains from said cathode.

41. The method of claim 25, for producing aluminium in a bipolar cell comprising passing an electric current from the surface of the terminal cathode to the surface of the terminal anode as ionic current in the electrolyte and as electronic current through the bipolar electrodes, thereby electrolysing the alumina dissolved in the electrolyte to produce aluminium on each cathode surface and oxygen on each anode surface.

42. The method of claim 25, comprising circulating the electrolyte between the anodes and facing cathodes thereby improving dissolution of alumina into the electrolyte and/or improving the supply of dissolved alumina under the active surfaces of the anodes.

43. A method of manufacturing an anode and producing aluminium in an electrolytic cell comprising inserting a iron-nickel alloy body or layer as an anode precursor into a fluoride-containing molten electrolyte of an electrolytic cell, and oxidising in-situ the surface of the anode precursor to produce an electrochemically active iron oxide-based layer, thereby converting the anode precursor into an anode as defined in claim 1, and electrolysing alumina in the same or in a different electrolyte to produce oxygen on the surface of the iron oxide-based layer and aluminium on a facing cathode.

44. The anode of claim 1, wherein the oxide-based layer is a hematite-based layer.

45. An anode of a cell for the electrowinning of aluminium by the electrolysis of alumina dissolved in a molten fluoride-containing electrolyte, the anode comprising a nickel-iron alloy-containing body or layer, an electrochemically-active iron oxide-based outside layer, and a nickel-ferrite selective membrane between the iron oxide-containing outside layer and the nickel-iron alloy-containing body or layer, the nickel-ferrite selective membrane preventing oxidation of the nickel-iron alloy-containing body or layer but permitting migration of iron metal from the nickel-iron alloy-containing body or layer to the iron oxide-containing outside layer where the migrated iron metal is oxidised to form iron oxide, the nickel-ferrite selective membrane being formed by surface oxidation of the nickel-iron alloy-containing body or layer.

46. The anode of claim 45, wherein the nickel-iron alloy-containing body or layer comprises a nickel-iron weight ratio greater than 1.

47. The anode of claim 46, wherein the nickel-iron alloy-containing body or layer comprises a nickel-iron weight ratio from 1.5 to 4.

48. The anode of chain 45, wherein the oxide-based layer is a hematite-based layer.

49. A cell for the electrowinning of aluminium by the electrolysis of alumina dissolved in a fluoride-containing molten electrolyte comprising at least one anode having a iron-nickel alloy body or layer and an outer iron oxide-based layer whose surface is electrochemically active and which reduces diffusion of oxygen from the electrochemically active surface into the iron-nickel alloy body or layer.

50. The cell of claim 49, wherein during normal operation the electrochemically active layer of the or each anode is progressively further formed by surface oxidation of the iron-nickel alloy body or layer by controlled oxygen diffusion through the electrochemically active layer, and progressively dissolved into the electrolyte at the electrolyte/anode interface, the rate of formation of the outer iron oxide-based layer being substantially equal to its rate of dissolution into the electrolyte.

51. The cell of claim 49, wherein the or each anode is kept dimensionally stable by maintaining a sufficient amount of dissolved alumina and iron species in the electrolyte to prevent dissolution of the outer oxide layer of the or each anode.

52. The cell of claim 51, which is operated at a sufficiently low temperature to limit the solubility of the outer iron oxide-based layer of the anode(s), thereby limiting the contamination of the product aluminium by constituents of the outer iron oxide-based layer of the anode(s).

53. The cell of claim 49, which is in a bipolar configuration, comprising a terminal cathode facing a terminal anode and thereinbetween at least one bipolar electrode, and wherein said anode(s) form(s) the anodic side of the or each bipolar electrode and/or of the terminal anode.

* * * * *